US008248155B2

(12) United States Patent
Lin et al.

(10) Patent No.: US 8,248,155 B2
(45) Date of Patent: Aug. 21, 2012

(54) VOLTAGE ADJUSTING CIRCUIT AND MOTHERBOARD INCLUDING THE SAME

(75) Inventors: Ping-Kun Lin, Taipei Hsien (TW); Song Guo, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 93 days.

(21) Appl. No.: 12/960,328

(22) Filed: Dec. 3, 2010

(65) Prior Publication Data

US 2012/0038413 A1 Feb. 16, 2012

(30) Foreign Application Priority Data

Aug. 13, 2010 (CN) ..... 2010 1 0252998

(51) Int. Cl.
*G05F 1/10* (2006.01)

(52) U.S. Cl. ..... 327/540

(58) Field of Classification Search ..... 327/530, 327/534, 535, 537, 538, 540
See application file for complete search history.

(56) References Cited

U.S. PATENT DOCUMENTS 7,605,809 B2 * 10/2009 Wey et al. ..... 345/212
2007/0114951 A1 * 5/2007 Tsen et al. ..... 315/291
* cited by examiner

*Primary Examiner* — Jeffrey Zweizig
(74) *Attorney, Agent, or Firm* — Altis Law Group, Inc.

(57) ABSTRACT

A voltage adjusting circuit includes a voltage regulator module (VRM), a control chip, a connection device, and a number of first resistors. The VRM includes an input receiving a first voltage from a motherboard, and an output connected to a liquid crystal display (LCD). A number of sense terminals of the control chip are connected to the LCD to sense current of the LCD. A driven terminal of the control chip is connected to a control terminal of the VRM to output corresponding driven signals to control the VRM to output corresponding voltage to the LCD. A first terminal of each first resistor is connected to a corresponding sense terminal of the control chip. A second terminal of each first resistor is grounded. The connection device is configured to cut off or connect the first resistor from or to the corresponding sense terminal of the control chip.

12 Claims, 2 Drawing Sheets

VOLTAGE ADJUSTING CIRCUIT AND MOTHERBOARD INCLUDING THE SAME

BACKGROUND

1. Technical Field

The present disclosure relates to a voltage adjusting circuit and a motherboard including the voltage adjusting circuit.

2. Description of Related Art

In some all-in-one computers, a converting board converts a +19 volt (V) output from a motherboard for supplying power to a liquid crystal display (LCD) of the computer. Because different LCDs have different voltage requirements, a converting board for each type of LCD must be custom designed, which is costly.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
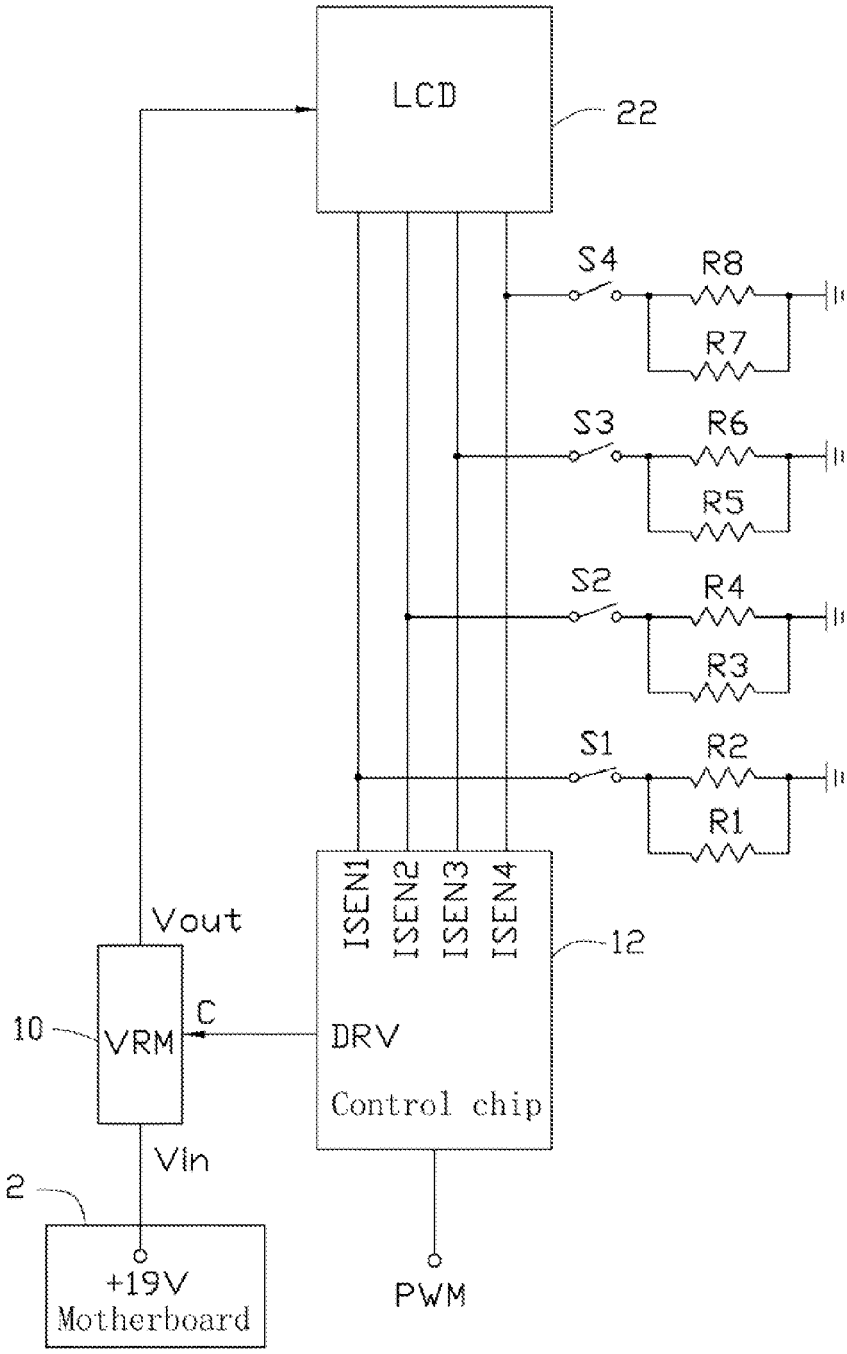
FIG. 1 is a schematic diagram of a first embodiment of a voltage adjusting circuit.

Referring to FIG. 1, a first embodiment of a voltage adjusting circuit includes a voltage regulator module (VRM) 10, a control chip 12, four switches S1-S4, and eight resistors R1-R8.

An input Vin of the VRM 10 receives a +19 volt (V) of a motherboard 2. An output Vout of the VRM 10 is connected to a liquid crystal display (LCD) 22. The VRM 10 converts the +19V to an appropriate voltage for supplying power to the LCD 22.

A control terminal C of the VRM 10 is connected to a driven terminal DRV of the control chip 12. Four sense terminals ISEN1-ISEN4 of the control chip 12 are connected to the LCD 22. The control chip 12 senses current of the LCD 22 through the four sense terminals ISEN1-ISEN4, and outputs a control signal to control the VRM 10 to output the proper voltage to the LCD 22. An input terminal of the control chip 12 receives a pulse width modulation (PWM) signal for adjusting brightness of the LCD 22.

A first terminal of the resistor R2 is connected to the sense terminal ISEN1 through the switch S1. A second terminal of the resistor R2 is grounded. The resistor R1 is connected to the resistor R2 in parallel. A first terminal of the resistor R4 is connected to the sense terminal ISEN2 through the switch S2. A second terminal of the resistor R4 is grounded. The resistor R3 is connected to the resistor R4 in parallel. A first terminal of the resistor R6 is connected to the sense terminal ISEN3 through the switch S3. A second terminal of the resistor R6 is grounded. The resistor R5 is connected to the resistor R6 in parallel. A first terminal of the resistor R8 is connected to the sense terminal ISEN4 through the switch S4. A second terminal of the resistor R8 is grounded. The resistor R7 is connected to the resistor R8 in parallel.

In the embodiment, the control chip 12 is an OZ9967 type control chip. According to the specification table of the OZ9967 type control chip, an equation to determine Vout may be used as follows:

$$V_{OUT} = \frac{2LI_{LED}}{D(1-D)^2T},$$

wherein $V_{OUT}$ stands for a voltage output from the VRM 10, L stands for an output inductance of the control chip 12, $I_{LED}$ stands for a sum of the current sensed by the four sense terminals ISEN1-ISEN4, D stands for a duty cycle of the PWM signals received by the control chip 12, T stands for an operation period of the control chip 12.

From the equation above, the voltage $V_{OUT}$ output from the VRM 10 is in direct proportion to the current $I_{LED}$ received by the control chip 12. In other words, when the current $I_{LED}$ varies, the voltage $V_{OUT}$ varies. Moreover, according to FIG. 1, when the switch S1 is turned on, the resistors R1 and R2 function as a current shunt. Therefore, the current $I_{LED}$ at this time is different from the current $I_{LED}$ when the switch S1 is turned off. As a result, the switches S1-S4 can be used to change the current $I_{LED}$, to change the voltage $V_{OUT}$ from the VRM 10.

According to the above, the relationship between different currents $I_{LED}$ and different voltages $V_{OUT}$ can be used to determine which of the switches S1-S4 to turn on to achieve a desired current $I_{LED}$ to make the voltage $V_{OUT}$ from the VRM 10 equal to the rated voltage of a particular LCD.

Figure 2:
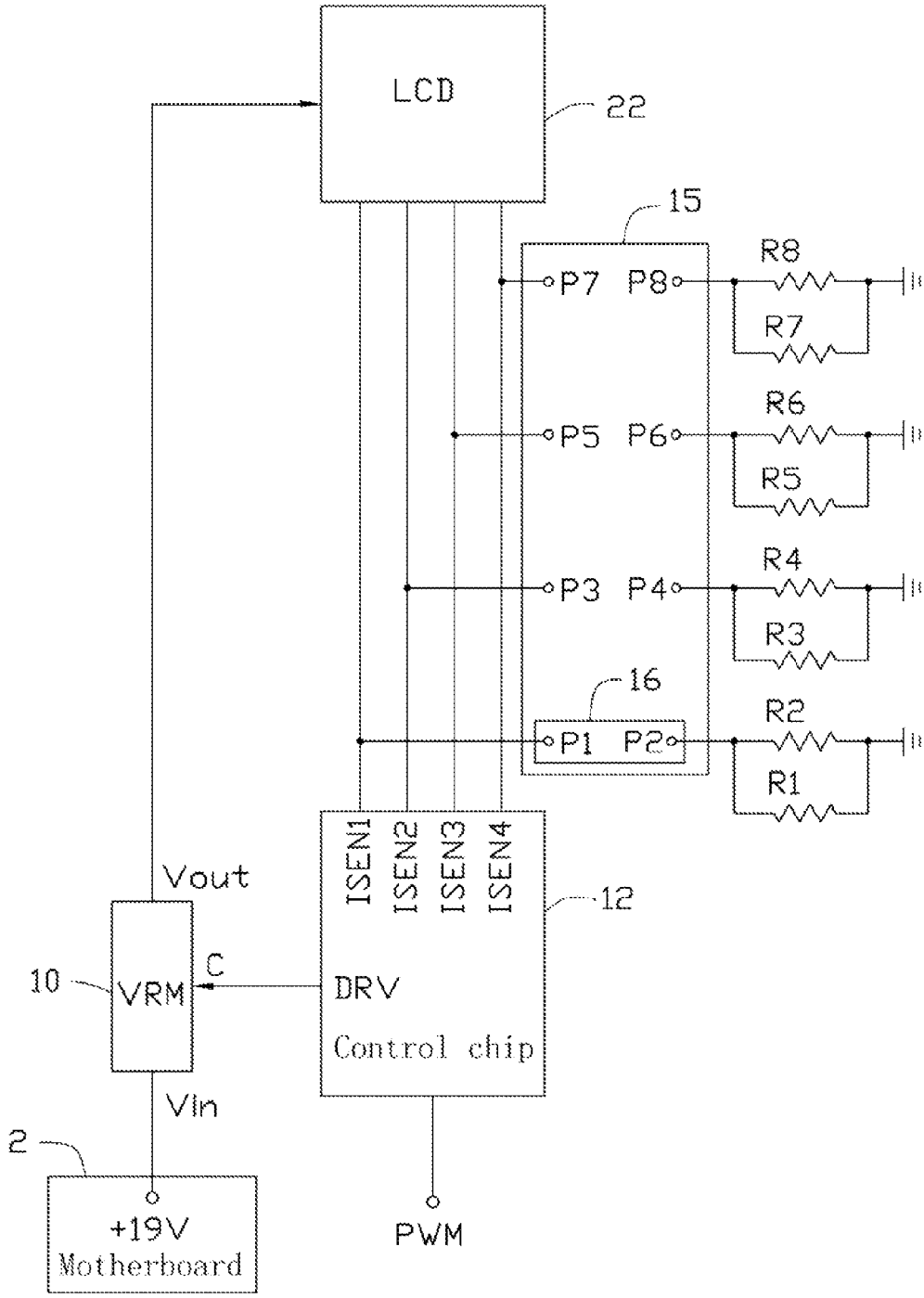
FIG. 2 is a schematic diagram of a second embodiment of a voltage adjusting circuit.

Referring to FIG. 2, a second embodiment of a voltage adjusting circuit is disclosed. In this embodiment of the voltage adjusting circuit, the four switches S1-S4 of the first embodiment are replaced by a connector 15. The connector 15 includes eight pins P1-P8. The pin P1 is connected to the sense terminal ISEN1 of the control chip 12. The pin P2 is grounded through the resistor R2. The resistor R1 is connected to the resistor R2 in parallel. The pin P3 is connected to the sense terminal ISEN2 of the control chip 12. The pin P4 is grounded through the resistor R4. The resistor R3 is connected to the resistor R4 in parallel. The pin P5 is connected to the sense terminal ISEN3 of the control chip 12. The pin P6 is grounded through the resistor R6. The resistor R5 is connected to the resistor R6 in parallel. The pin P7 is connected to the sense terminal ISEN4 of the control chip 12. The pin P8 is grounded through the resistor R8. The resistor R7 is connected to the resistor R8 in parallel. The pins P1 and P2 can be connected by a jumper 16. The pins P3 and P4 can be connected by a jumper. The pins P5 and P6 can be connected by a jumper. The pins P7 and P8 can be connected by a jumper.

Similar to the first embodiment, the connection between the pins P1 and P2, P3 and P4, P5 and P6, P7 and P8 can be controlled using the jumpers to change the current $I_{LED}$, thus to change the voltage $V_{OUT}$ from the VRM 10. As a result, the voltage adjusting circuit can provide different voltages for different LCDs.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A voltage adjusting circuit comprising:

a voltage regulator module (VRM) comprising an input receiving a first voltage from a motherboard, an output connected to a liquid crystal display (LCD), and a control terminal;

a control chip comprising a plurality of sense terminals connected to the LCD to sense current of the LCD, and a driven terminal connected to the control terminal of the VRM to output corresponding driven signals to control the VRM to output corresponding voltage to the LCD according to the current sensed;

a connection device; and a plurality of first resistors, wherein a first terminal of each first resistor is connected to a corresponding sense terminal of the control chip, a second terminal of each first resistor is grounded, the connection device is configured to cut off or connect the first resistor from or to the corresponding sense terminal of the control chip.

2. The voltage adjusting circuit of claim 1, further comprising a plurality of second resistors, wherein each second resistor is connected to a corresponding first resistor in parallel.

3. The voltage adjusting circuit of claim 2, wherein the connection device comprises a plurality of switches, each switch is connected between a first resistor and a corresponding sense terminal of the control chip.

4. The voltage adjusting circuit of claim 2, wherein the connection device comprises a connector, the connector comprises a plurality of groups of pins, each group of pins comprises a first pin and a second pin, each first pin is connected to a corresponding sense terminal of the control chip, each second pin is connected to a corresponding first resistor, each group of pins are configured to be connected by a jumper.

5. The voltage adjusting circuit of claim 1, wherein the connection device comprises a plurality of switches, each switch is connected between a first resistor and a corresponding sense terminal of the control chip.

6. The voltage adjusting circuit of claim 1, wherein the connection device comprises a connector, the connector comprises a plurality of groups of pins, each group of pins comprises a first pin and a second pin, each first pin is connected to a corresponding sense terminal of the control chip, each second pin is connected to a corresponding first resistor, each group of pins are configured to be connected by a jumper.

7. A motherboard comprising:

a first voltage; and a voltage adjusting circuit, wherein the voltage adjusting circuit comprises:

a voltage regulator module (VRM) comprising an input receiving the first voltage, an output connected to a liquid crystal display (LCD), and a control terminal;

a control chip comprising a plurality of sense terminals connected to the LCD to sense current of the LCD, and a driven terminal connected to the control terminal of the VRM to output corresponding driven signals to control the VRM to output corresponding voltage to the LCD according to the current sensed;

a connection device; and a plurality of first resistors, wherein a first terminal of each first resistor is connected to a corresponding sense terminal of the control chip, a second terminal of each first resistor is grounded, the connection device is configured to cut off or connect the first resistor from or to the corresponding sense terminal of the control chip.

8. The motherboard of claim 7, wherein the voltage adjusting circuit comprises a plurality of second resistors, each second resistor is connected to a corresponding first resistor in parallel.

9. The motherboard of claim 8, wherein the connection device comprises a plurality of switches, each switch is connected between a first resistor and a corresponding sense terminal of the control chip.

10. The motherboard of claim 8, wherein the connection device comprises a connector, the connector comprises a plurality of groups of pins, each group of pins comprises a first pin and a second pin, each first pin is connected to a corresponding sense terminal of the control chip, each second pin is connected to a corresponding first resistor, each group of pins are configured to be connected by a jumper.

11. The motherboard of claim 7, wherein the connection device comprises a plurality of switches, each switch is connected between a first resistor and a corresponding sense terminal of the control chip.

12. The motherboard of claim 7, wherein the connection device comprises a connector, the connector comprises a plurality of groups of pins, each group of pins comprises a first pin and a second pin, each first pin is connected to a corresponding sense terminal of the control chip, each second pin is connected to a corresponding first resistor, each group of pins are configured to be connected by a jumper.

* * * * *